US007003243B2

(12) United States Patent
Yamashita

(10) Patent No.: US 7,003,243 B2
(45) Date of Patent: Feb. 21, 2006

(54) CHARGER AND IMAGE FORMING APPARATUS

(75) Inventor: Toshimi Yamashita, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/801,719

(22) Filed: Mar. 17, 2004

(65) Prior Publication Data

US 2005/0207778 A1 Sep. 22, 2005

(51) Int. Cl.
*G03G 15/02* (2006.01)

(52) U.S. Cl. ..... 399/100

(58) Field of Classification Search ..... 399/100, 399/173; 361/213, 222, 225, 229, 230; 250/324–326
See application file for complete search history.

(56) References Cited

U.S. PATENT DOCUMENTS 3,842,273 A 10/1974 Van Buskirk
4,788,573 A * 11/1988 Nakaoka et al. ..... 399/100
5,532,798 A * 7/1996 Nakagami et al. ..... 399/170
5,563,692 A 10/1996 Cho
5,940,656 A * 8/1999 Hensel ..... 399/100
5,946,529 A * 8/1999 Sato et al. ..... 399/100
6,415,120 B1 * 7/2002 Tashiro et al. ..... 399/100
2003/0194249 A1 * 10/2003 Kawamura ..... 399/100
2005/0074256 A1 * 4/2005 Yamashita ..... 399/100

FOREIGN PATENT DOCUMENTS

JP 6-194934 A 7/1994
JP 7-043990 A 2/1995
JP 7-049606 A 2/1995
JP 9-211940 A 8/1997
JP 11-327265 A 11/1999

OTHER PUBLICATIONS

U.S. Appl. No. 10/679,363, Yamashita, filed Oct. 7, 2003.

* cited by examiner

*Primary Examiner*—Sandra L. Brase
(74) *Attorney, Agent, or Firm*—Foley & Lardner LLP

(57) ABSTRACT

A charger in one embodiment of this invention includes an electrode cleaning mechanism having a film-like elastic sheet which is deformed by a provided predetermined stress, wherein deposits deposited on the edge of a sawtooth electrode are removed, and a potential above a certain level can be given to the surface of a photoconductor drum.

17 Claims, 6 Drawing Sheets

| Current to flow through electrode ($\mu$A) | Before cleaning | Conventional cleaning | Cleaning of present invention |
|---|---|---|---|
| 900 | × | ○ | ○ |
| 800 | × | ○ | ○ |
| 700 | × | ○ | ○ |
| 600 | × | △ | ○ |
| 500 | × | × | ○ |
| 400 | × | × | ○ |
| 300 | × | × | ○ |

×: Blank parts stain
△: Blank parts don't stain but half tone parts are uneven
○: Stainless

CHARGER AND IMAGE FORMING APPARATUS

BACKGROUND OF THE INVENTION

1. Field of the Invention

This invention relates to an image forming apparatus which forms an image on a transfer material by use of an electrophotographic process, and a charger installed in this image forming apparatus.

2. Description of the Related Art

A corona discharge type fixing device installed in an image forming apparatus using an electrophotographic process is classified broadly into a wire electric discharge type (Corotron, Scorotron, etc.) or pin discharge type (pin electrode, sawtooth electrode, etc.).

In a method generally known, a cleaning member such as felt provided to wrap around a wire electrode is moved in a longitudinal direction (axial direction of a photoconductor drum) of a charger, as a means to clean the wire electric discharge type wire electrode.

Another method is known in which a cylindrical cleaning member provided movably along the sawtooth electrode is moved while being pressed against the edge of the sawtooth electrode, as a means to clean the pin discharge type sawtooth electrode (Jpn. Pat. Appln. KOKAI Publication No. 9-211940).

Still another method is known in which the sawtooth electrode is rotatably provided, and electric discharge products deposited on the edge of the sawtooth electrode are scraped against the cleaning member (Jpn. Pat. Appln. KOKAI Publication No. 11-327265).

Furthermore, apparatuses or methods are known in which a driving force generator such as a motor is used to automatically clean the electrode of the charger (Jpn. Pat. Appln. KOKAI Publication No. 6-194934, Jpn. Pat. Appln. KOKAI Publication No. 7-49606, U.S. Pat. No. 3,842,273).

However, the abovementioned method using the cylindrical cleaning member in which cleaning is achieved by the rolling and contacting of a roller has the disadvantage that the electric discharge products, toner, dust and the like deposited on the edge of the sawtooth electrode are not adequately removed because of insufficient cleaning power.

Moreover, the problem of the above-described method of cleaning the rotatably provided sawtooth electrode is that the edge of the sawtooth electrode warps and deforms when it contacts the cleaning member, and the cleaning power decreases as the cleaning is performed time and time again. Further, the warping and deforming of the sawtooth edge cause improper corona discharge and insufficient electric discharge to an image carrier.

BRIEF SUMMARY OF THE INVENTION

According to an aspect of the present invention, there is provided a charger comprising:

an electrode having a plurality of protrusions and giving a predetermined potential to an image carrier;

a cleaning mechanism contacting the electrode, and removing deposits electrostatically deposited on the electrode; and a moving mechanism which moves the cleaning mechanism along the electrode.

According to another aspect of the present invention, there is provided a charger comprising:

an electrode having a plurality of protrusions and which is a sheet-shaped electric conductor having a first plane including a straight line in an axial direction of an image carrier;

a cleaning mechanism which includes a sheet portion having a second plane disposed vertically to the first plane of the electrode, and a holding member to movably hold the sheet portion so that the second plane of the sheet portion vertically contacts the first plane of the electrode.

According to further another aspect of the present invention, there is provided an image forming apparatus comprising:

an image carrier which holds a latent image and a developer image;

a charger including an electrode, a cleaning mechanism and a moving mechanism, the electrode having a plurality of protrusions and giving a predetermined potential to the image carrier, the cleaning mechanism contacting the electrode and removing deposits electrostatically deposited on the electrode, the moving mechanism moving the cleaning mechanism along the electrode;

a development device which supplies a developer to the image carrier to which the predetermined potential is supplied by the charger; and a transfer device which transfers the developer image formed on the image carrier onto an output medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One example of a charger installed in an image forming apparatus to which embodiments of this invention are applied will hereinafter be described with reference to the drawings.

First Embodiment

Figure 1:
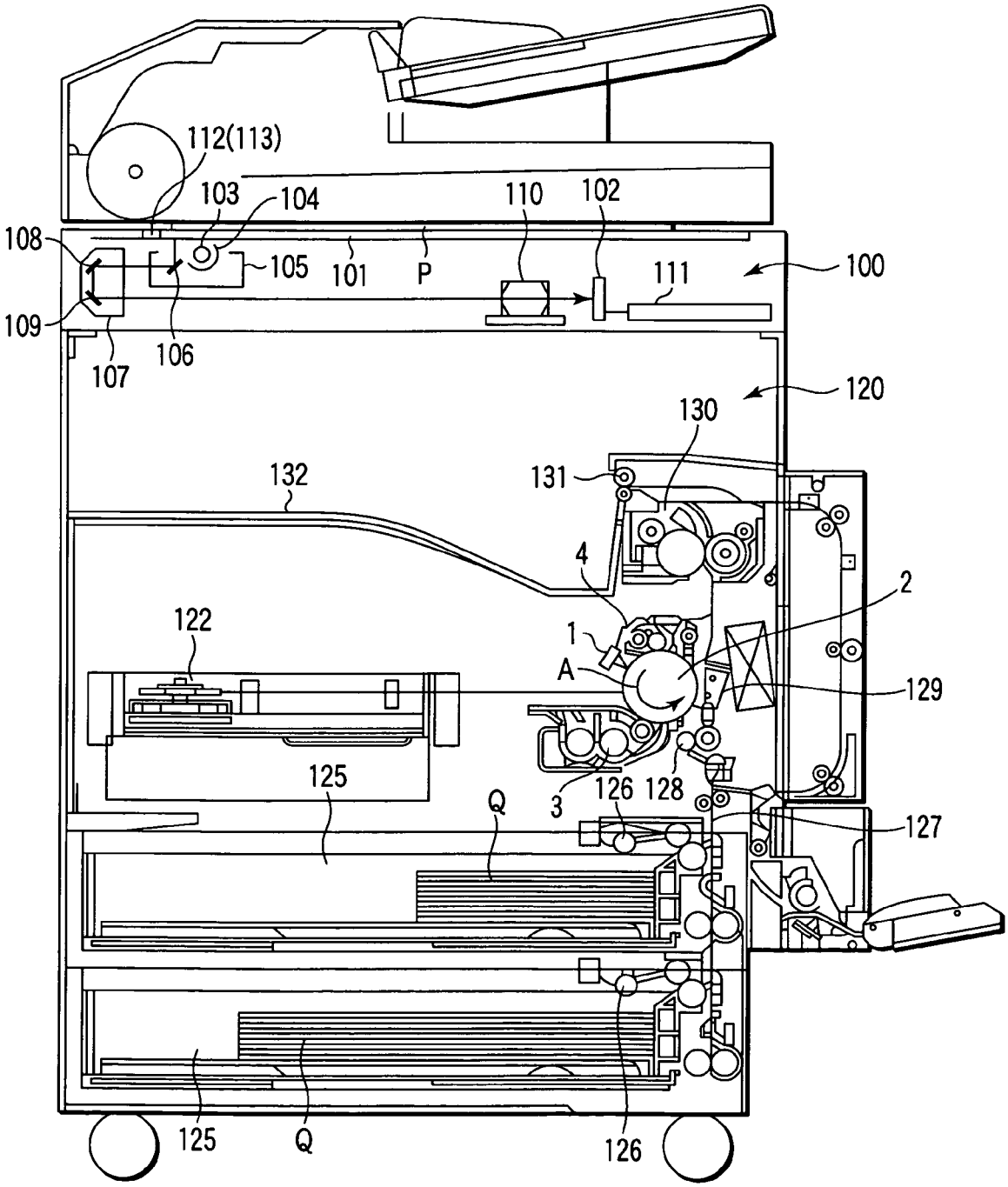
FIG. 1 is a schematic diagram illustrating an image forming apparatus to which a first embodiment of this invention can be applied.

FIG. 1 shows one example of the image forming apparatus to which first and second embodiments of this invention are applied.

As shown in FIG. 1, the image forming apparatus comprises a scanner (image reading device) 100 which reads an image to be read (copied) and generates a first image signal, and an image forming section 120 which forms an image on the basis of a second image signal.

The scanner 100 comprises an original table 101, an illumination lamp 103, a reflector 104, a first carriage 105, a first mirror 106, a second carriage 107, a second mirror 108, a third mirror 109, a lens 110, photoelectric transfer element (CCD sensor) 102 and an image processor 111.

The original table 101 is made of a light transmitting material, and holds a copy target (original) P which is a solid body such as a book or a sheet-shaped original.

The illumination lamp 103 irradiates light from under the original table 101.

The reflector 104 condenses the light emitted by the illumination lamp 103 at a predetermined position of the original table 101.

The illumination lamp 103 and the reflector 104 are fixed to the first carriage 105, and the first carriage 105 moves back and forth along a surface of the original table 101.

The first mirror 106 guides, into a predetermined direction (the second carriage 107), a reflected light from the original P illuminated by an illumination light from the illumination lamp 103 and the reflector 104, that is, image information on the original P. The reflected light from the original P will hereinafter be referred to as an image light, for description.

The second carriage 107 moves the second mirror 108 and the third mirror 109 held by the second carriage 107 along the surface of the original table 101 in conjunction with the first carriage 105.

The second mirror 108 bends the image light reflected by the first mirror 106 at 90°, and guides it to the third mirror 109.

The third mirror 109 bends the image light reflected by the second mirror 108 at 90°, and guides it to the lens 110.

The lens 110 gives a predetermined image formation magnification to the guided image light, and forms an image on the CCD sensor 102 disposed at a focal position of the lens 110.

The CCD sensor 102 converts the image information (image light) concerning the original P into an electrical signal, and outputs the first image signal.

The image processor 111 subjects the first image signal output by the CCD sensor 102 to predetermined image processing, and outputs the image information as the second image signal.

The image forming section 120 comprises a charger 1, an exposure device 122, a photoconductor drum 2, a development device 3, a sheet cassette 125, a pickup roller 126, a conveying path 127, an aligning roller 128, a transfer device 129, a fixing device 130, a delivery roller 131, a tray 132 and a cleaning device 4.

The charger 1 discharges electricity at a predetermined discharge position, and supplies a predetermined electric charge to an outer peripheral surface of the photoconductor drum 2.

The exposure device 122 outputs a laser beam whose light intensity is changed, on the basis of the second image signal output by the image processor 111. This laser beam is incident on the outer peripheral surface of the photoconductor drum 2 which is charged with a predetermined potential in an axial direction by the charger 1.

The photoconductor drum 2 is irradiated with the laser beam and holds an electrostatic image corresponding to the image of the original P, that is, an electrostatic latent image.

The development device 3 provides a developer (e.g., toner) to the photoconductor drum 2 that rotates in a direction of an arrow A, and the unshown electrostatic latent image is converted into a toner image.

The sheet cassette 125 contains paper Q.

The pickup roller 126 takes out the paper Q one by one from the sheet cassette 125, and guides it to the conveying path 127.

The conveying path 127 has a plurality of rollers, and guides the paper Q to the photoconductor drum 2.

The aligning roller 128 once stops the paper Q guided by the conveying path 127 to align the unshown toner image with a position on the paper Q on which the toner image is to be transferred, and then conveys the paper Q to the photoconductor drum 2 with predetermined timing.

The transfer device 129 electrostatically transfers the toner image onto the paper Q at a transfer position opposite to the photoconductor drum 2, that is, at a predetermined position on a downstream side of a rotation direction of the development device 3.

The fixing device 130 secures or fixes the unshown toner image, which has been transferred onto the paper Q, to the paper Q.

The delivery roller 131 discharges, to the image output media holder (tray) 132, the paper Q on which the unshown toner image has been fixed by the fixing device 130, that is, an image corresponding to the image information on the original P is formed.

The tray 132 is located in a space defined between the scanner 100 and the sheet cassette 125.

The cleaning device 4 is located downstream of the rotation direction of the photoconductor drum 2 from the transfer position and upstream from the discharge position, and removes the remaining toner, which has not been transferred, from the surface of the photoconductor drum 2.

In addition, the charger 1, the photoconductor drum 2, the development device 3 and the cleaning device 4 are provided as one unit (process unit) in the image forming section 120.

When instructed to read or form the image of the original P, the scanner 100 outputs the first image signal based on the original P to the image processor 111. The image processor 111 outputs the second image signal to the exposure device 122. The exposure device 122 applies the laser beam to the photoconductor drum 2, and forms an electrostatic image. The electrostatic image is converted into a toner image by the development device 3. The toner image is transferred onto the paper Q by the transfer device 129. The fixing device 130 fixes the toner to the paper Q, that is, the image of the original P is formed on the paper Q.

Figure 2:
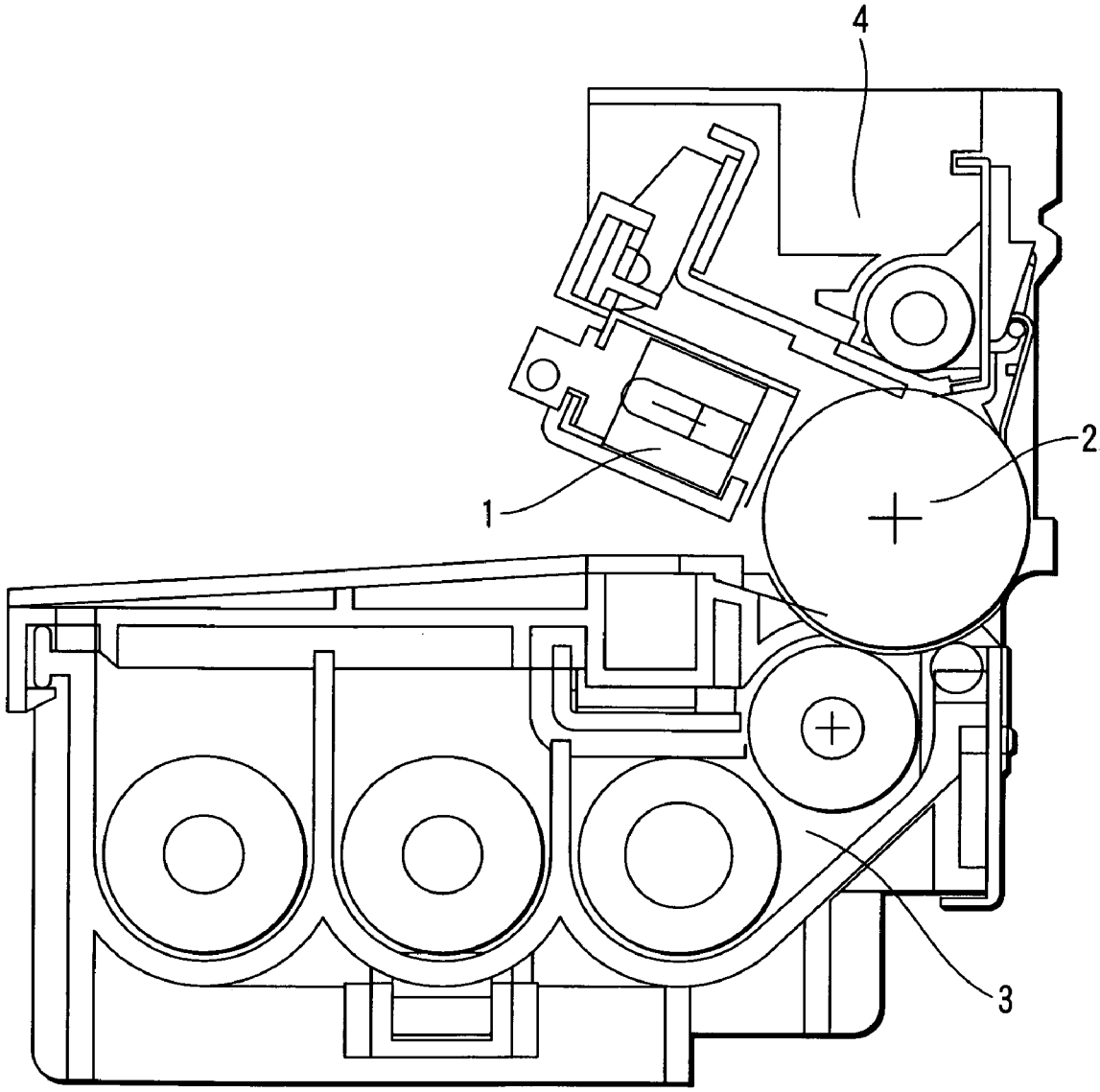
FIG. 2 is a schematic diagram illustrating a charger to which the first embodiment of this invention can be applied.

FIG. 2 is a sectional view of the process unit comprising the charger to which the first embodiment is applied.

As shown in FIG. 2, the process unit comprises the charger 1, the photoconductor drum 2, the development device 3 and the cleaning device 4.

The charger 1 discharges electricity at the predetermined discharge position, and supplies the predetermined electric charge to the outer peripheral surface of the photoconductor drum 2.

The photoconductor drum 2 is given a predetermined potential by the charger 1 and irradiated with the laser beam whose intensity is modulated in accordance with the image information from the exposure device 122, thereby retaining an electrostatic latent image corresponding to the image to be copied.

The development device 3 provides the developer (e.g., toner) to the photoconductor drum 2, and the electrostatic latent image formed on the photoconductor drum 2 is converted into a toner image. This toner image is transferred, by an electric field provided from the transfer device 129, onto transfer paper conveyed almost vertically from under the process unit. The toner image transferred onto the transfer paper is conveyed to the fixing device 130 where the toner is melted and fixed to the transfer paper.

The cleaning device 4 is located downstream of the rotation direction of the photoconductor drum 2 from the transfer position and upstream from the discharge position, and removes the remaining toner, which has not been transferred, from the surface of the photoconductor drum 2.

Figure 3:
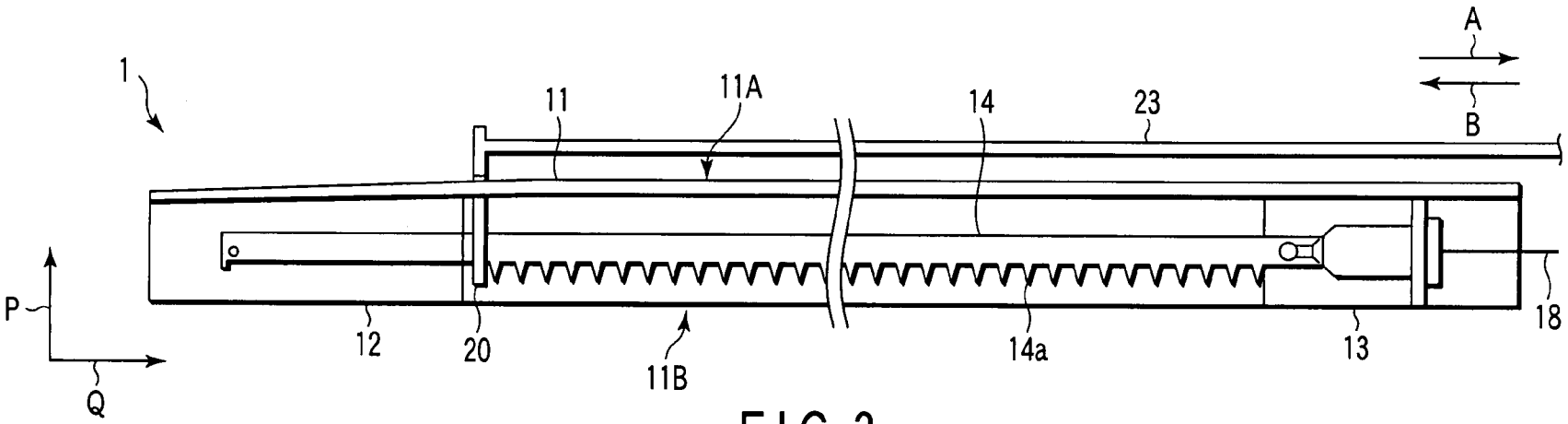
FIG. 3 is a schematic diagram of the charger shown in FIG. 2.
Figure 4:
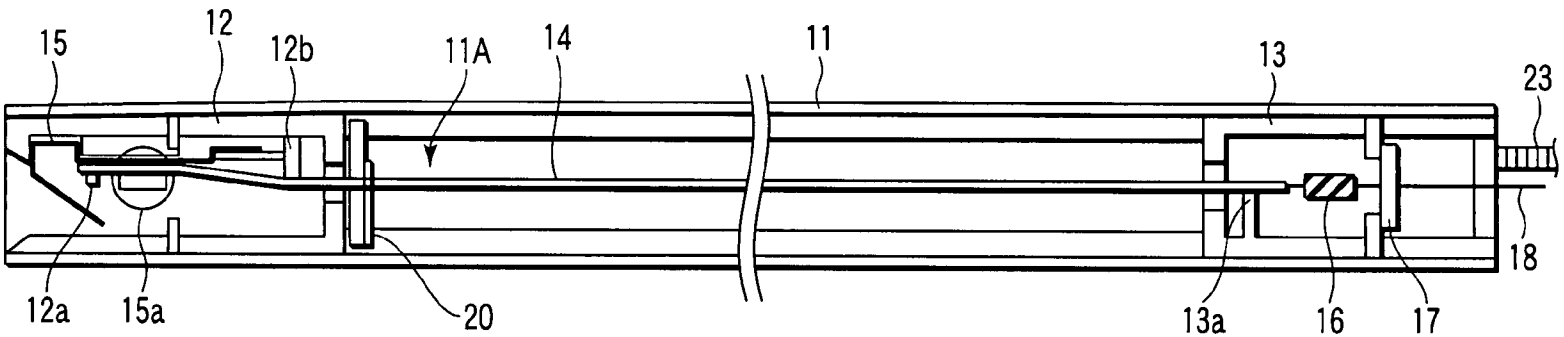
FIG. 4 is a schematic diagram of the charger shown in FIG. 3 viewed from another direction.

FIG. 3 shows one example of the charger to which the embodiment of the present invention can be applied. FIG. 4 is a schematic diagram of the charger shown in FIG. 3 viewed from below (from a lower opening 11B which will be described later).

As shown in FIGS. 3 and 4, the charger 1 has a shield plate 11, support members 12 and 13, an electrode 14, a feeding plate 15, a spring 16, a fixing plate 17 and an electrode cleaning mechanism 20.

As shown in FIG. 3, the shield plate 11 has an upper opening 11A and the lower opening 11B, and is disposed at a predetermined position of the process unit so that the lower opening 11B is opposite to the surface of the photoconductor drum 2.

The support members 12 and 13 are respectively fixed at both ends of the shield plate 11 in a predetermined manner (e.g., by screws). In addition, the support members 12 and 13 are preferably made of an insulating material.

The electrode 14 is made of a conductive material, for example, stainless steel having a predetermined length in the axial direction, that is, longitudinal direction (lateral direction) of the photoconductor drum 2, and has a shape in which a plurality of charging needles 14*a* is formed on one side as shown in FIG. 3. More specifically, the electrode 14 is made of, for example, a stainless steel material having a thickness of 0.1 mm, and has the plurality of charging needles 14*a*, which are formed by etching and have, for example, a height of 2 mm and a curvature at the end R of 30 $\mu$m, at certain intervals, for example, at intervals of 2 mm. Further, the electrode 14 is disposed so that a predetermined space of, for example, 9.2 mm is kept between a side where the charging needles 14*a* are formed and the surface of the photoconductor drum 2. Moreover, the electrode 14 is disposed to keep a predetermined space or more of, for example, 7 mm between the electrode 14 and the shield plate 11, which makes it possible to reduce current leakage to the shield plate 11 due to the electric discharge from the electrode 14.

In addition, the charging needle preferably has a sharper edge for more efficient electric discharge. However, as in the present embodiment, the charging needle 14*a* has a certain degree of curvature at the edge to reduce manufacturing labor and deterioration of the charging needles 14*a* due to the electric discharge, thereby ensuring a longer life. Therefore, in the present invention, a plurality of charging needles having an acute angle may be formed in the electrode.

The electrode 14 is disposed at a predetermined position by protrusions 12*a*, 12*b* and 13*a* (see FIG. 4) that are formed in the support members 12 and 13. One end of the electrode 14 is supported by a pinching portion 15*a* of the feeding plate 15 which is provided in the holding member 12 and has spring properties. Further, the other end of the electrode 14 is connected to the fixing plate 17 via the spring 16, and fixed by the holding member 13. In other words, the electrode 14 is held by the holding members 12 and 13 with predetermined tension given thereto. The electrode 14 is connected to a feeding portion 18, and is electrically connected to, for example, a high-voltage generating mechanism 411 which will be described later (see FIG. 9).

The electrode cleaning device 20 is usually located at one end of the electrode 14, for example, on the side of the holding member 12 so as not to affect the electric discharge to the photoconductor drum 2 (see FIGS. 3 and 4).

In addition, the holding members 12 and 13 and the fixing plate 17 are made of an insulating resin, for example, polypropylene (PP) resin in the present embodiment.

Figure 5:
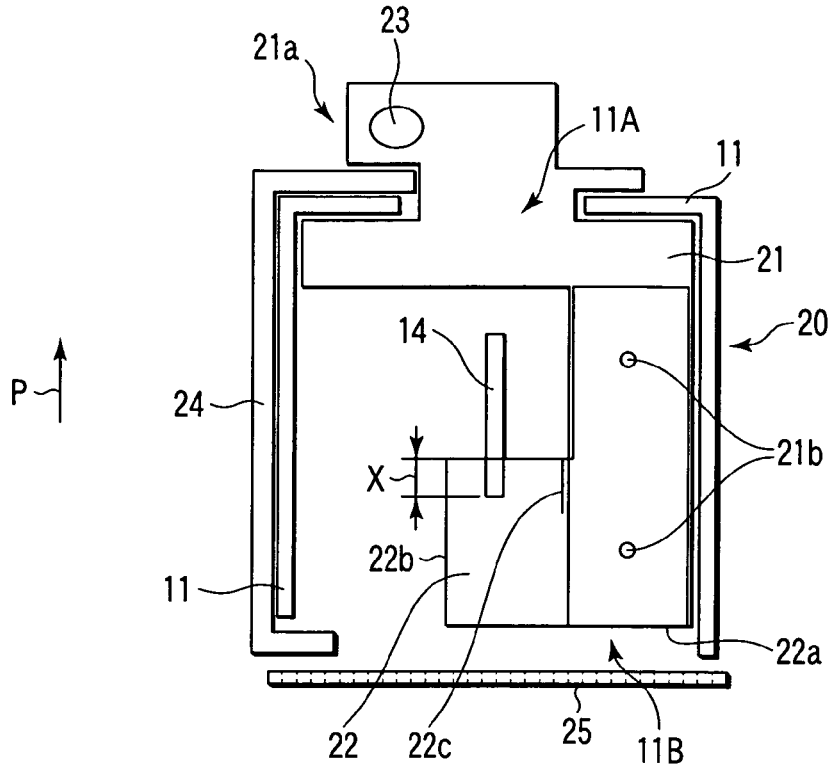
FIG. 5 is a sectional view of the charger shown in FIG. 3.

FIG. 5 is a longitudinal sectional view of the electrode cleaning device 20.

As shown in FIG. 5, the electrode cleaning device 20 has a plate 21, a cleaning sheet 22, a moving bar 23, a holding plate 24 and a grid 25.

The plate 21 is made of the insulating resin, for example, polypropylene (PP) resin, and has such a shape as to be able to move the shield plate 11 in the longitudinal direction without contacting the electrode 14. More specifically, the plate 21 has a locking portion 21*a* protruding from the upper opening 11A, and the hooked plate 21 can move in the upper opening 11A in the longitudinal direction sliding along the shield plate 11.

The cleaning sheet 22 is a film-like elastic sheet made of polyester, polyimide, polyamide or the like as represented by a Mylar sheet (trademark) or Kapton sheet (trademark), and is held at a predetermined position of the plate 21. In other words, the cleaning sheet 22 has a hardness lower than that of the electrode 14 made of stainless steel. The cleaning sheet 22 is positioned by protrusions 21*b*, and adhesively bonded to the plate 21, for example, via double-sided tape. In addition, the protrusions 21*b* can be melted to prevent the cleaning sheet 22 from being peeled from the plate 21.

More specifically, the cleaning sheet 22 has a thickness ranging from 10 to 100 $\mu$m, and preferably 25 to 75 $\mu$m. In the present embodiment, the cleaning sheet having thickness of 50 $\mu$m is used. Further, an abrasive may be applied to the surface of the cleaning sheet 22. This makes it possible to more effectively remove the electric discharge products and the like deposited on the electrode 14.

For example, silicon carbide, silicon nitride, cerium oxide, ferric oxide, chromic oxide and alumina can be used as the abrasive, and the particle diameter is 0.01 to 2 $\mu$m, preferably 0.01 to 1 $\mu$m.

The cleaning sheet 22 includes a first sheet portion 22*a* fixed to the plate 21, and a second sheet portion 22*b* that is moved to contact the electrode 14, as described above.

Figure 6:
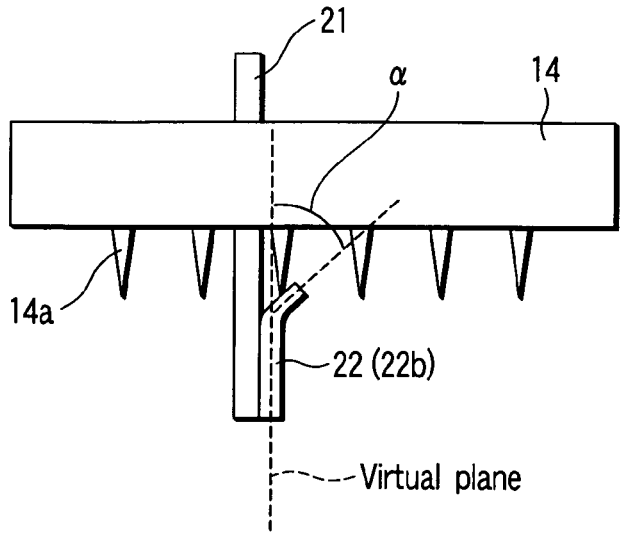
FIG. 6 is a diagram illustrating a change in the shape of a cleaning sheet shown in FIG. 5.

The second sheet portion 22*b* has such a shape as to be able to contact the side of the electrode 14 where the charging needles 14*a* are formed with a predetermined amount X (hereinafter referred to as an encroaching amount), and the second sheet portion 22*b* deforms due to a cut portion 22*c* formed between the second sheet portion 22*b* and the first sheet portion 22*a*, as the contacting electrode 14 moves, that is, as a predetermined stress is provided (see FIG. 6). In addition, the deformed second sheet portion 22*b* can cause vibration or impact to the electrode 14 by use of a force to recover from the deformation. This makes it possible to more effectively remove deposits.

It should be noted that the encroaching amount X is the amount in design in which the cleaning sheet 22 overlaps the edge of the charging needles 14*a* of the electrode 14 in an undeformed state in a sectional view, as shown in FIG. 5, and that X may be 0.1 to 1.5 mm, while in the present embodiment, X=0.5. Moreover, the cut portion 22*c* may be 2 to 8 mm, and is 4 mm in the present embodiment. In addition, the encroaching amount X is associated with durability or variation, which will be described later, in connection with the deformation caused by the contact with the electrode, and the encroaching amount X differs depending on the size of the apparatus and the material of the cleaning sheet. The present invention is not limited to the present embodiment.

Furthermore, the second sheet portion 22*b* of the cleaning sheet 22 has a second plane including a straight line in a direction of an arrow P (see FIG. 3). When the second plane is not in contact with the electrode 14, the second plane is disposed vertically to a first plane of the electrode 14 including a straight line in a direction of an arrow Q (see FIG. 3). Moreover, by maintaining the encroaching amount X above a certain level, the second plane can vertically contact the electrode 14 when it is moved. The variation in the shape of the cleaning sheet 22 at this moment is in a range where virtual angle $\alpha=\pm 90°$ with respect to a virtual plane parallel to the second plane when the electrode 14 is not in contact with the cleaning sheet 22, i.e., with respect to a plane which includes a virtual line vertical to an axial direction of the photoconductor drum 2 and which is vertical to the first plane of the electrode 14.

The moving bar 23 has a predetermined length in a longitudinal direction of the charger 1, and one end of which is fixed by the locking portion 21*a* of the plate 21, while the other end is utilized as a drawing portion for a user to draw the moving bar 23 from a front side of the apparatus. In addition, the present embodiment concerns a manual type in which movement force of the electrode cleaning mechanism 20 is provided by the user, and the moving bar 23 may be modified in accordance with the apparatus as long as it is placed at a position where the user can operate.

The holding plate 24 is disposed outside the shield plate 11, and serves as a shield plate to regulate an area where the electrode 14 discharges electricity so that the electric discharge does not influence circuits or the like disposed in the proximity thereof. In addition, the holding plate 24 may have a configuration such that deposits such as the toner, dust and waste thread removed by the electrode cleaning device 20 can be stored.

It should be noted that in the present embodiment, the charger is obliquely disposed (see FIG. 1), the deposits removed by the electrode cleaning device 20 free-fall to be accumulated on the holding plate 24. The grid 25 is provided between the electrode 14 and the surface of the photoconductor drum 2, and disposed to keep a certain space, for example, 8 mm between the grid 25 and the electrode 14 in the axial direction (the arrow Q direction shown in FIG. 3). Further, the grid 25 is made of a predetermined conductive member, for example, a stainless steel material, and is formed by etching into a predetermined shape, for example, a mesh shape with a predetermined thickness of, for example, about 0.1 mm. The grid 25 can control the electric charge supplied from the electrode 14 to the photoconductor drum 2, so that the electric charge supplied to the photoconductor drum 2 stabilizes within a predetermined range.

Next, an operation of the electrode cleaning mechanism 20 will be described.

As shown in FIG. 3, the cleaning sheet 22 is held by the plate 21 to be placed at a predetermined position (hereinafter referred to as a home position HP.) where it does not affect the electric discharge of the electrode 14. As the moving bar 23 is moved in the arrow A direction, the second sheet portion 22*b* of the cleaning sheet 22 is moved in the arrow A direction while contacting along the edge, which has a predetermined curvature, of the charging needles 14*a* of the electrode 14. Moreover, the charging needles 14*a* are subjected to vibration or impact. In this way, the contact of the cleaning sheet 22 cleans contamination such as the electric discharge products, dust and toner deposited on the charging needles 14*a*.

Continuously, the moving bar 23 is moved in an arrow B direction, so as to place the cleaning sheet 22 at the home position HP. Accordingly, the cleaning sheet 22 moved in the arrow A direction contacts the charging needles 14*a*, and stuck contamination is further cleaned.

Figures 7, 8:
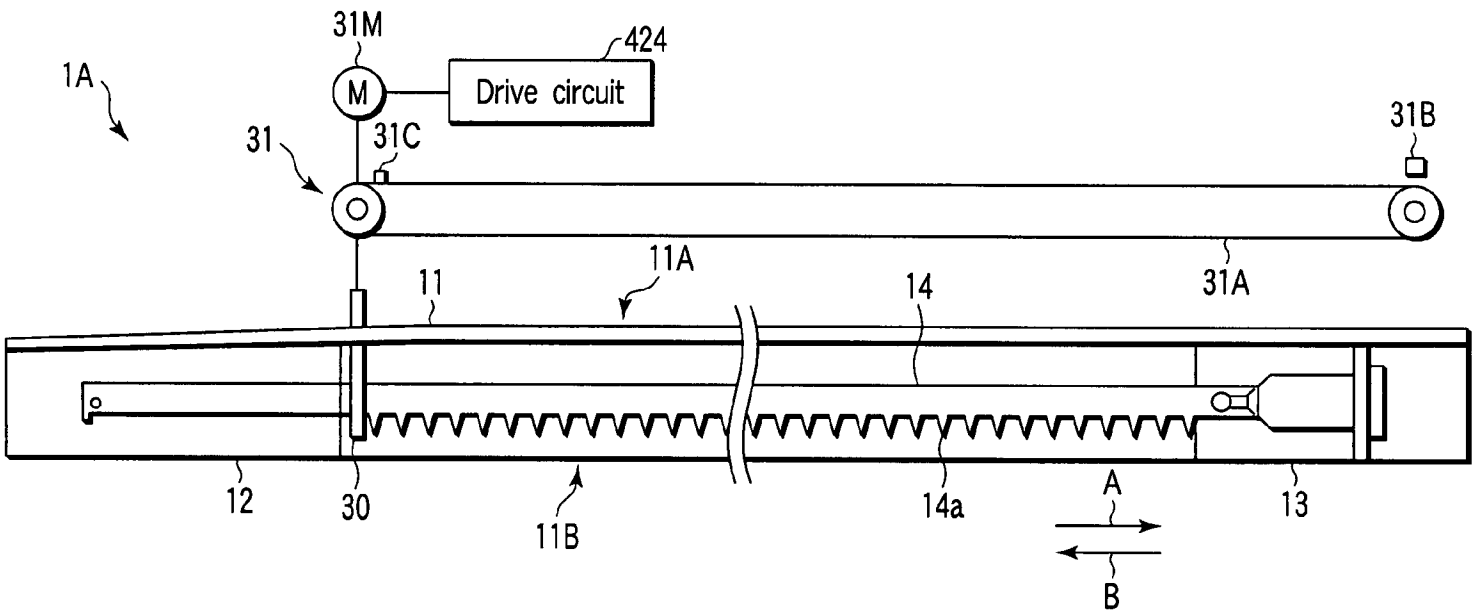
FIG. 7 is a block diagram illustrating a control system of the charger shown in FIG. 2.
FIG. 8 is a reference diagram to explain cleaning effects of a cleaning mechanism to which this invention can be applied.

FIG. 7 is a reference diagram explaining cleaning effects when an embodiment of the present invention having the above-described configuration is used to clean the sawtooth electrode.

More specifically, an image to be copied including a blank image and a halftone image is obtained by, for example, the scanner 120, and the exposure device 122 is used to form the electrostatic latent image, corresponding to the image to be copied, on the surface of the photoconductor drum 2, and then the image is fixed on the transfer paper as described above with reference to FIG. 1. At this moment, a current supplied to the electrode of the charger 1 is changed from 300 $\mu$A to 900 $\mu$A, and (1) to (3) described below as samples are used to make a comparison.

It should be noted that the image forming apparatus equipped with the charger that supplies a current of about 700 $\mu$A to 500 $\mu$A has been used in the present embodiment, but because this current value varies depending upon the apparatus in which the charger is used, a current of 300 $\mu$A to 900 $\mu$A has been experimentally used.

For example, the same current is supplied to the charger and the same number of electrostatic latent images of the same image is formed on the photoconductor drum, thereby preparing, as the samples, the electrodes 14 having the same degree of contamination such as the electric discharge products, dust and toner deposited on the charging needles 14*a*. For example, the samples used include (1) a sample 1 as the electrode which is not cleaned and has contamination stuck thereto, (2) a sample 2 as the electrode having the charging needles cleaned in a conventional cleaning method, and (3) a sample 3 as the electrode having the charging needles cleaned by use of the electrode cleaning mechanism 20 of the present invention.

As shown in FIG. 7, in the sample 1 that is not cleaned, at any value of supplied current, blank parts in a copy are uneven, and a satisfactory image cannot be obtained. In the sample 2, when a current of 700 $\mu$A or higher is supplied, a satisfactory image can be obtained, but when a current of 600 $\mu$A or lower is supplied, the contamination remaining without being cleaned restricts the electric discharge of the electrode, with the result that halftone parts or blank parts are uneven, and a satisfactory image cannot be obtained. In the sample 3, a satisfactory image can be obtained at any value of supplied current.

Furthermore, when heavier contamination is stuck and a copied image has unevenness or the like even though the cleaning has been performed, the cleaning can naturally be performed again by again moving the moving bar 23.

As described above, according to the first embodiment of the present invention, the film-like elastic sheet is used as the cleaning sheet, and the film-like elastic sheet is provided in such a manner that it can deform in accordance with movement, so that the edge of the charging needles of the electrode can be prevented from being damaged or buckling, and adequate cleaning effects can be obtained.

Second Embodiment

Next, the charger to which the second embodiment is applied will be described.

As shown in FIG. 8, a charger 1A has the shield plate 11, the support members 12 and 13, the electrode 14, the feeding plate 15, the spring 16, the fixing plate 17, which are provided in the charger 1 described above, and an electrode cleaning mechanism 30 operated by an electrical signal.

The electrode cleaning mechanism 30 includes the plate 21 and the cleaning sheet 22 that constitute the electrode cleaning mechanism 20 described above, and additionally has a moving mechanism 31 which holds the plate 21 and can move the plate 21 with an electrical signal. It is to be noted that the same components as in the first embodiment have the same functions in the present embodiment, and will not be described.

The moving mechanism 31 includes a configuration to move the plate 21 in the longitudinal direction (arrow A, B directions) of the electrode 14, for example, a conveying means 31A in a shape of a wire, rail or belt to fix the plate 21 at a predetermined position, a motor 31M which provides power to the conveying means 31A, and an electrode cleaning mechanism position detecting sensor 31B for detecting the position of the plate 21 moved by the moving mechanism 31.

When the conveying means 31A is provided with power by the motor 31M, the plate 21 which has been positioned at the home position is moved in the arrow A direction, and the cleaning sheet 22 is also moved in the arrow A direction contacting the electrode 14. The electrode cleaning mechanism position detecting sensor 31B is located, for example, at one end of the movement direction (arrow A, B directions) of the plate 21, and detects a sensor 31C provided on a home position side of the conveying means 31A, for example, when the plate 21 is not moved, thus informing a printer CPU 420, which will be described later, that the cleaning sheet 22 has been moved from end to end in the longitudinal direction of the electrode 14. In this way, the printer CPU 420 instructs a drive circuit 424 so that predetermined power to move the plate 21 in the arrow B direction will be provided from the motor 31M to the conveying means 31A. Accordingly, the cleaning sheet 22 is moved in the arrow B direction contacting the electrode 14, and placed at an initial position (home position).

Figure 9:
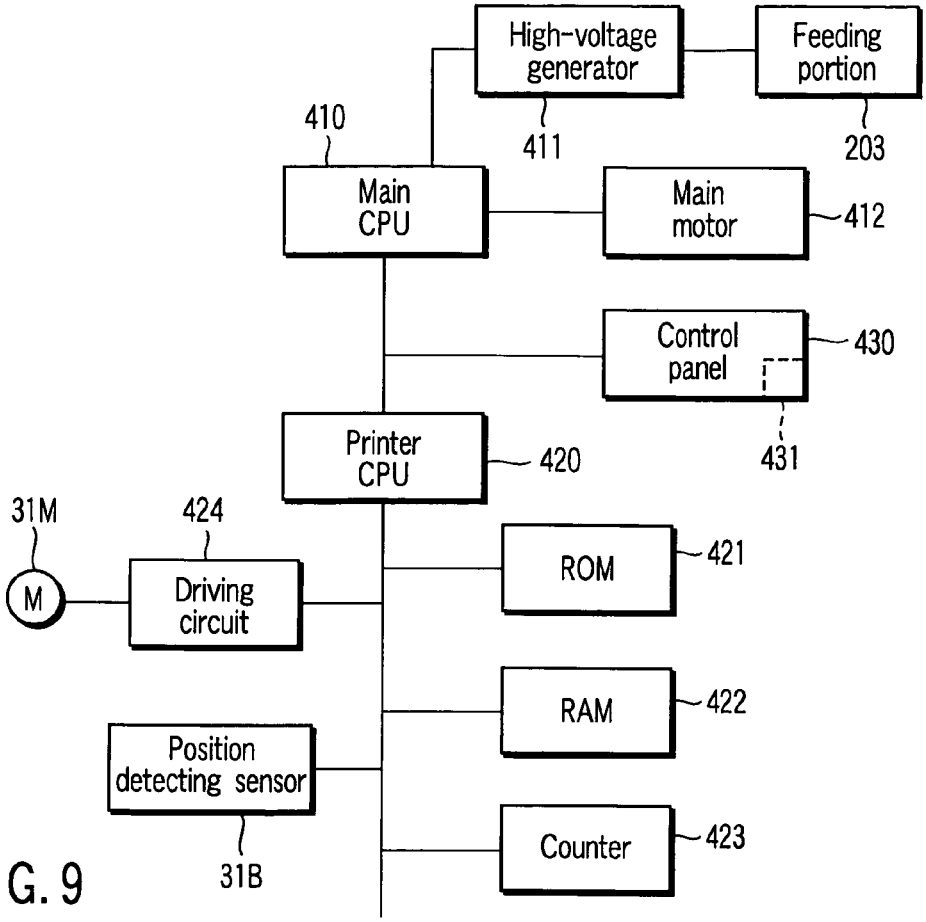
FIG. 9 is a schematic diagram illustrating the charger to which a second embodiment of this invention can be applied.

FIG. 9 is a block diagram illustrating a control system which operates the image forming apparatus including the charger 1A shown in FIG. 8.

As shown in FIG. 9, a main CPU 410 is connected to the printer CPU 420 and a control panel 430.

The main CPU 410 totally controls parts of the image forming apparatus.

The printer CPU 420 totally controls parts of the image forming section 120.

The control panel 430 comprises an operation portion 431, and communicates instructions from the user to the main CPU 410 and the printer CPU 420.

When instructed to form an image from the operation portion 431 by the user, the printer CPU 420 outputs a charging signal for the plurality of charging needles 14*a* of the electrode 14 to start discharging electricity.

The main CPU 410 outputs a high-voltage generating signal when the charging signal is input from the printer CPU 420.

Moreover, when instructed to remove the deposits, the printer CPU 420 outputs a drive signal to drive the drive circuit 424 with predetermined timing.

The main CPU 410 is connected to the high-voltage generating mechanism 411 and a main motor 412.

The high-voltage generating mechanism 411 is connected to an electric power supply section (not shown) which supplies electric power to operate the image forming apparatus, and supplied with predetermined electric power. When the high-voltage generating signal is input from the main CPU 410, the high-voltage generating mechanism 411 generates high-voltage electric power required for the electric discharge of the electrode 14 to charge the photoconductor drum 2 with a predetermined potential, and supplies electric power to the supply portion 18 connected to the electrode 14.

The main motor 412 operates parts included in the scanner 100, the image forming section 120 and the like, for example, the first and second carriages 105 and 107 or the photoconductor drum 2.

The printer CPU 420 is connected to a ROM 421, a RAM 422, a counter 423 and the drive circuit 424.

The counter 423 counts the number of output media (paper Q) on which the image has been formed in the image forming section 120, and informs the printer CPU 420 of the number.

The ROM 421 stores a program to totally control the parts of the image forming section 120, and a dedicated program to control the electric discharge of the electrode 14 or to control the motor 31M. Further, in the present embodiment, the ROM 421 stores such a program that when a number NQ1 of output media counted by the counter 423 reaches a print stipulated value NQ2 (e.g., 1000 sheets) which might cause an unsatisfactory image to be formed, the printer CPU 420 outputs the drive signal.

The RAM 422 has a work area necessary for the printer CPU 420 to perform a predetermined processing operation.

The drive signal is input to the drive circuit 424 from the printer CPU 420, and the drive circuit 424 operates the motor 31M connected thereto.

Next, operation of the electrode cleaning mechanism 30 will be described.

Figure 10:
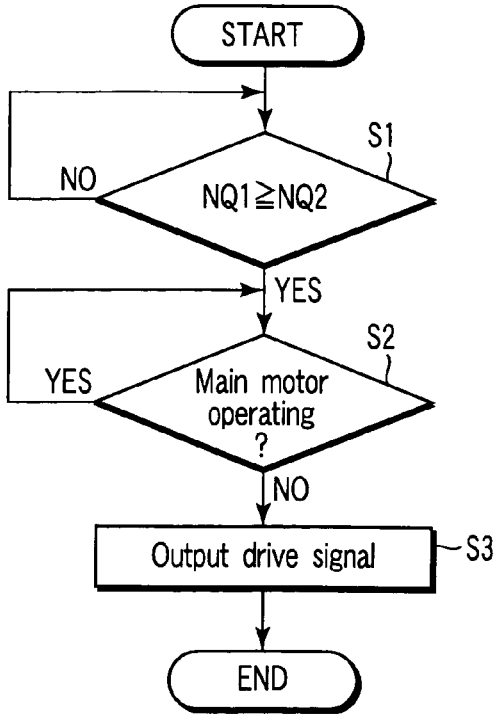
FIG. 10 is a flowchart explaining one example of a method of operating the electrode cleaning mechanism shown in FIG. 9.

FIG. 10 is a flowchart explaining one example of a method of operating the electrode cleaning mechanism shown in FIG. 9.

As shown in FIG. 10, the printer CPU 420 compares the number NQ1 of output media counted by the counter 423 with the print stipulated value NQ2 (S1).

When the counted number NQ1 of output media is 1000 or more (S1—YES), the printer CPU 420 continuously monitors a motor drive signal of an unshown motor driver circuit, and judges whether or not the main motor 412 is operating (S2). When the main motor 412 is not operating (S2—NO), the drive signal is output (S3).

When the drive signal is input to the drive circuit 424, the motor 31M is driven as described above, and the cleaning sheet 22 moves back and forth in the directions of arrows A and B, and then the deposits are shaken off by contact or vibration and impact, and removed.

In addition, when the main motor 412 is operating, that is the time when both or one of the scanner 100 and the image reading section 120 are/is operating. Therefore, when the image forming section 120 is forming an image, that is, when the toner image is being formed on the photoconductor drum 2, there is no possibility that the deposits are shaken off on the surface of the photoconductor drum 2. Moreover, when the scanner 100 is operating, the vibration generated by the motor 31M is transmitted, so that there is no possibility of trouble caused to a reading operation.

Furthermore, it has been described in the present embodiment that the time to operate the drive circuit 424 of the electrode cleaning mechanism 30 is when the number of output media becomes a predetermined number or more, to which the present invention is not limited, and this time may be when an instruction is given from the control panel 430 (operation portion 431).

What is claimed is:

1. A charger comprising:

an electrode having a plurality of charging needles and which is a sheet-shaped electric conductor having a first plane including a straight line in an axial direction of an image carrier; and an electrode cleaning mechanism contacting tip ends of the charging needles, and including a sheet section having a second plane arranged perpendicularly to the first plane of the electrode, and a holding member for holding the sheet section along an axial direction of an image carrier.

2. The charger according to claim 1, wherein the sheet section changes in shape based on predetermined stress.

3. The charger according to claim 2, wherein the sheet section comprises a film-like elastic sheet including a material selected from the group consisting of polyester, polyimide, and polyamide.

4. The charger according to claim 2, wherein the sheet section has a thickness of 10 to 100 $\mu$m.

5. The charger according to claim 2, wherein the sheet section has a thickness of 25 to 75 $\mu$m.

6. The charger according to claim 2, wherein an encroaching amount of the sheet section on the electrode is 0.1 to 1.5 mm.

7. The charger according to claim 2, wherein an abrasive is applied to a surface of the sheet section.

8. The charger according to claim 2, further comprising a holding plate capable of retaining the deposits removed from the electrode by the electrode cleaning mechanism.

9. The charger according to claim 1, wherein the second plane of the sheet section is vertical to the first plane, and deforms within a range of −90° to 90° with respect to a virtual plane which includes a virtual line vertical to an axis of the image carner.

10. An image forming apparatus comprising:

an image carrier which holds a latent image and a developer image;

a charger including an electrode, an electrode cleaning mechanism and a moving mechanism, the electrode having a plurality of charging needles and which is a sheet-shaped electric conductor having a first plane including a straight line in an axial direction of an image carrier, the electrode cleaning mechanism contacting tip ends of the charging needles, and including a sheet section having a second plane arranged perpendicularly to the first plane of the electrode, and a holding member for holding the sheet section along an axial direction of an image carrier, the moving mechanism moving the electrode cleaning mechanism along the electrode;

a development device which supplies a developer to the image carrier to which the predetermined potential is supplied by the charger; and a transfer device which transfers the developer image formed on the image carrier onto an output medium.

11. The image forming apparatus according to claim 10, wherein the moving mechanism comprises a driving means, and operates the driving means when the number of output media becomes a predetermined number or more.

12. The image forming apparatus according to claim 11, wherein the driving means is not operated while an image is being formed.

13. The image forming apparatus according to claim 11, wherein the sheet section is a film-like elastic sheet including a material selected from the group consisting of polyester, polyimide, and polyamide.

14. The image forming apparatus according to claim 11, wherein an abrasive is applied to a surface of the sheet section.

15. The image forming apparatus according to claim 11, further comprising a holding plate capable of retaining the deposits removed from the electrode by the electrode cleaning mechanism.

16. The image forming apparatus according to claim 10, wherein the moving mechanism comprises the driving means, and operates the driving means with an instruction from a control panel.

17. The image forming apparatus according to claim 10, wherein the sheet section changes in shape based on predetermined stress.

* * * * *